US011011856B2

(12) United States Patent
Foo

(10) Patent No.: US 11,011,856 B2
(45) **Date of Patent: *May 18, 2021**

(54) DUAL VERTICAL BEAM CELLULAR ARRAY

(71) Applicant: Huawei Technologies Co., Ltd., Shenzhen (CN)

(72) Inventor: Senglee Foo, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 557 days.

This patent is subject to a terminal disclaimer.

(21) Appl. No.: 15/845,582

(22) Filed: Dec. 18, 2017

(65) Prior Publication Data

US 2018/0109007 A1 Apr. 19, 2018

Related U.S. Application Data

(63) Continuation of application No. 14/184,517, filed on Feb. 19, 2014, now Pat. No. 9,899,747.

(51) Int. Cl.

| | |
|---|---|
| ***H01Q 25/00*** | (2006.01) |
| ***H01Q 1/24*** | (2006.01) |
| ***H01Q 21/08*** | (2006.01) |

(52) U.S. Cl.

CPC ..... *H01Q 25/00* (2013.01); *H01Q 1/246* (2013.01); *H01Q 21/08* (2013.01); *H01Q 25/002* (2013.01)

(58) Field of Classification Search

CPC ..... H01Q 21/08; H01Q 3/40; H01Q 3/26

See application file for complete search history.

(56) References Cited

U.S. PATENT DOCUMENTS

| | | | | |
|---|---|---|---|---|
| 5,649,287 | A | 7/1997 | Forssen et al. | |
| 5,966,102 | A * | 10/1999 | Runyon | H01Q 1/246 343/797 |
| 6,218,987 | B1 | 4/2001 | Derneryd et al. | |
| 6,311,075 | B1 * | 10/2001 | Bevan | H01Q 1/246 342/368 |
| 6,661,375 | B2 * | 12/2003 | Rickett | H01Q 3/22 342/372 |
| 7,724,176 | B1 * | 5/2010 | Pruett | H01Q 3/02 342/25 R |

(Continued)

FOREIGN PATENT DOCUMENTS

| | | | |
|---|---|---|---|
| CN | 1434991 | A | 8/2003 |
| CN | 1540903 | A | 10/2004 |

(Continued)

*Primary Examiner* — Marcus E Windrich

(74) *Attorney, Agent, or Firm* — Slater Matsil, LLP

(57) ABSTRACT

A dual vertical beam cellular array is disclosed herein. In one embodiment, a cellular array includes discrete radiators coupled in pairs and arranged in-line. The radiators are connected to hybrid couplers configured to sum the output from the pairs of discrete radiators. A first power distribution network is configured to receive a first output from the hybrid couplers and produce a first beam, and a second power distribution network configured to receive a second output from the hybrid couplers and produce a second beam. According to some embodiments, the first beam is a main beam with high gain and the second beam is a coverage beam with a large coverage area.

20 Claims, 3 Drawing Sheets

(56) References Cited

U.S. PATENT DOCUMENTS

| | | | | |
|---|---|---|---|---|
| 8,988,274 | B2 * | 3/2015 | Zhang | G01S 13/95 342/26 R |
| 2002/0075195 | A1 | 6/2002 | Powell et al. | |
| 2002/0080073 | A1 | 6/2002 | Wastberg | |
| 2003/0151553 | A1 | 8/2003 | Ylitalo | |
| 2006/0068848 | A1 * | 3/2006 | Shapira | H01Q 3/26 455/562.1 |
| 2006/0264242 | A1 | 11/2006 | Dent | |
| 2008/0030416 | A1 * | 2/2008 | Lee | H01Q 1/1292 343/754 |
| 2009/0058725 | A1 * | 3/2009 | Barker | H04B 7/0408 342/372 |
| 2009/0322608 | A1 * | 12/2009 | Adams | H01Q 25/002 342/368 |
| 2010/0141527 | A1 * | 6/2010 | Lalezari | H01Q 21/24 342/368 |
| 2011/0006966 | A1 | 1/2011 | Tanabe | |
| 2011/0134008 | A1 * | 6/2011 | Schadler | H01Q 21/065 343/833 |
| 2011/0205119 | A1 * | 8/2011 | Timofeev | H01Q 1/246 342/373 |
| 2012/0274514 | A1 | 11/2012 | Petersson et al. | |
| 2018/0062258 | A1 | 3/2018 | Timofeev et al. | |

FOREIGN PATENT DOCUMENTS

| | | | |
|---|---|---|---|
| CN | 201490330 | U | 5/2010 |
| CN | 102257674 | A | 11/2011 |
| CN | 102544757 | A | 7/2012 |
| JP | H05299934 | A | 11/1993 |
| JP | H0697731 | A | 4/1994 |
| JP | 2001523425 | A | 11/2001 |
| JP | 2009218677 | A | 9/2009 |
| RU | 2155460 | C2 | 8/2000 |
| WO | 9850981 | | 11/1998 |
| WO | 0241450 | A1 | 5/2002 |
| WO | 2006123227 | A2 | 11/2006 |

* cited by examiner

DUAL VERTICAL BEAM CELLULAR ARRAY

CROSS-REFERENCE TO RELATED APPLICATIONS

This application is a continuation of U.S. patent application Ser. No. 14/184,517, filed on Feb. 19, 2014, which application is hereby incorporated herein by reference.

TECHNICAL FIELD

The present invention generally relates to the field of antenna arrays. More specifically, the present invention is related to cellular antenna arrays that produce dual vertical beams.

BACKGROUND

As wireless devices have exploded in popularity, the ability to provide sufficient coverage to more and more users over large areas is more crucial than ever. Current cellular antenna array techniques have reach the limiting factor in meeting these demands. Typically, these antenna arrays produce a single, narrow beam in the vertical plane. As such, there is a growing need to provide wireless coverage with higher capacity without significant increase in cost and complexity.

In current implementations, cellular arrays typically produce a single, narrow beam in the vertical plane. Because the vertical beam is typically narrow, the angle of the beam must be adjusted using a sub-system to achieve optimum network coverage. The use of a sub-system such as a remote elevation tilt (RET) adds complexity and cost to the cellular array.

Furthermore, it is desirable to produce a vertical beam with broad half power beam width without sacrificing overall directivity of the antenna. Current antenna arrays with a relatively long antenna length will have higher gain but at the cost of a narrower beam pattern. Conversely, antenna arrays with a broader beam pattern have a reduced antenna length leading to lower overall directivity and gain. As such, current antenna arrays tend to produce a solution that offers compromise between overall network capacity and overall coverage.

There is a need then for a cellular array implementation that is simple and cost effective, while at the same time providing a large, reliable coverage area without sacrificing directivity and gain.

SUMMARY

A dual vertical beam cellular array is disclosed herein, where two simultaneous vertical beams are produced using a single antenna aperture. In one approach, a cellular array features one or more pairs of discrete radiators. One or more hybrid couplers are used to sum the output from the pairs of discrete radiators. A first power distribution network receives a first output from the one or more hybrid couplers and produces a first beam, and a second power distribution network receives a second output from the one or more hybrid couplers and produces a second beam.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF ILLUSTRATIVE EMBODIMENTS

Figure 1:
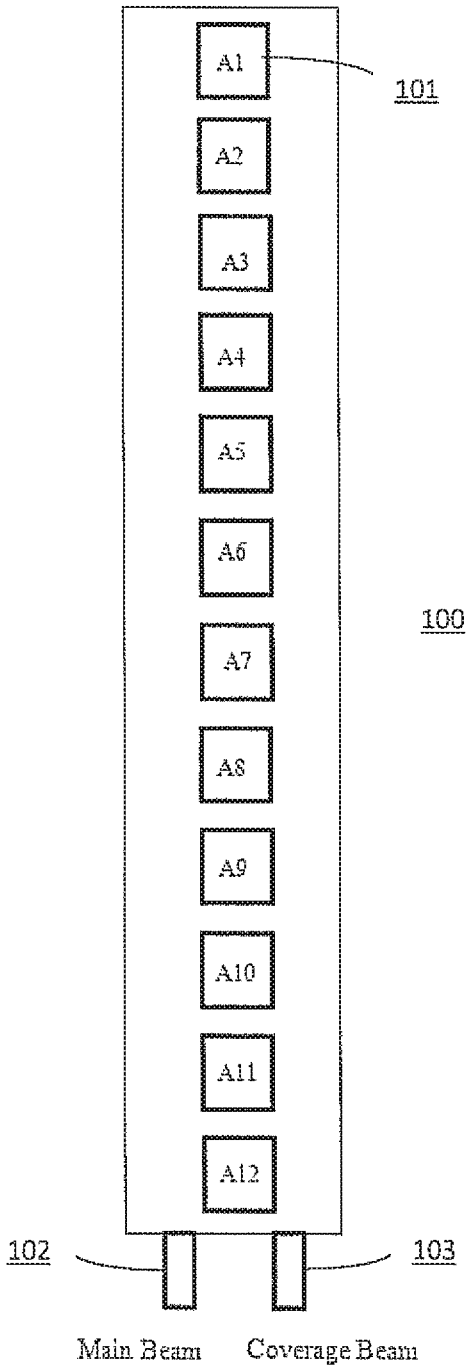
FIG. 1 is a block diagram of an exemplary array architecture.

Reference will now be made in detail to several embodiments. While the subject matter will be described in conjunction with the alternative embodiments, it will be understood that they are not intended to limit the claimed subject matter to these embodiments. On the contrary, the claimed subject matter is intended to cover alternative, modifications, and equivalents, which may be included within the spirit and scope of the claimed subject matter as defined by the appended claims.

Furthermore, in the following detailed description, numerous specific details are set forth in order to provide a thorough understanding of the claimed subject matter. However, it will be recognized by one skilled in the art that embodiments may be practiced without these specific details or with equivalents thereof. In other instances, well-known methods, procedures, components, and circuits have not been described in detail as not to unnecessarily obscure aspects and features of the subject matter.

Portions of the detailed description that follows are presented and discussed in terms of a method. Embodiments are well suited to performing various other steps or variations of the steps recited in the flowchart of the figures herein, and in a sequence other than that depicted and described herein.

Some portions of the detailed description are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer-executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a cellular antenna array. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout, discussions utilizing terms such as "accessing," "writing," "including," "storing," "transmitting," "traversing," "associating," "identifying" or the like, refer to the action and processes of an antenna array, or similar electronic computing device, that manipulates and transforms data represented as physical (electronic) quantities within the system's registers and memories into other data similarly represented as physical quantities within the system memories or registers or other such information storage, transmission or display devices.

The present invention relates to a cellular array with dual vertical beams that can provide increased network gain with broad cellular coverage in the vertical plane. With this implementation, vertical beam pointing using a RET subsystem is not necessary. The dual beam array accomplishes higher network gain and large coverage in the elevation plane using two independent beams in the vertical plane. In one embodiment, the antenna array produces a main, narrow beam for high gain operation at low tilt angles (near the horizon). The second beam has a wide and/or fan-shaped beam pattern in the elevation plane and is optimized for broader signal coverage in the closer range at higher tilt angles. This concept improves network gain using a main beam with narrower beam pattern without loss of elevation coverage since the second fan-shaped beam can provide the required coverage at higher down-tilt.

As a result of the feed structure, these two beams are inherently orthogonal and the beam patterns can be designed such that the beam coupling factor of the two radiation patterns is relatively low for optimum network performance. This ensures low signal interference between the two coverage regions. As a result, simultaneous operation of the two spatial beams in two independent channels using the same frequency spectrum is possible. Furthermore, the two beams may be steered independently, if desired.

Furthermore, in-situ beam pointing angle adjustment using a remote down-tilt device such the RET is no longer required. The concept can be used in any typical three-sector or six-sector cellular network, for example. This array uses typical low-cost linear array architecture and therefore does not increase overall complexity. On the contrary it reduces the overall cost of the array by eliminating the requirement for a RET sub-system.

Embodiments of the invention will now be described, although it will be understood that they are not intended to limit the claimed subject matter to these embodiments.

With regard now to FIG. 1, the general architecture of a cellular linear array 100, consisting of typical 12 rows of discrete radiators (i.e., radiator 101) in a single column, is depicted according to some embodiments. The elements can be any broadband radiators such as a broadband patch or dipoles. As discussed above, two independent beams are produced at main beam port 102 and coverage beam Port 103. The main beam provides high-gain operation near the horizon. The coverage beam with a wide and/or fan-shaped pattern handles larger coverage in the near-range at high down-tilt angles.

Figure 2:
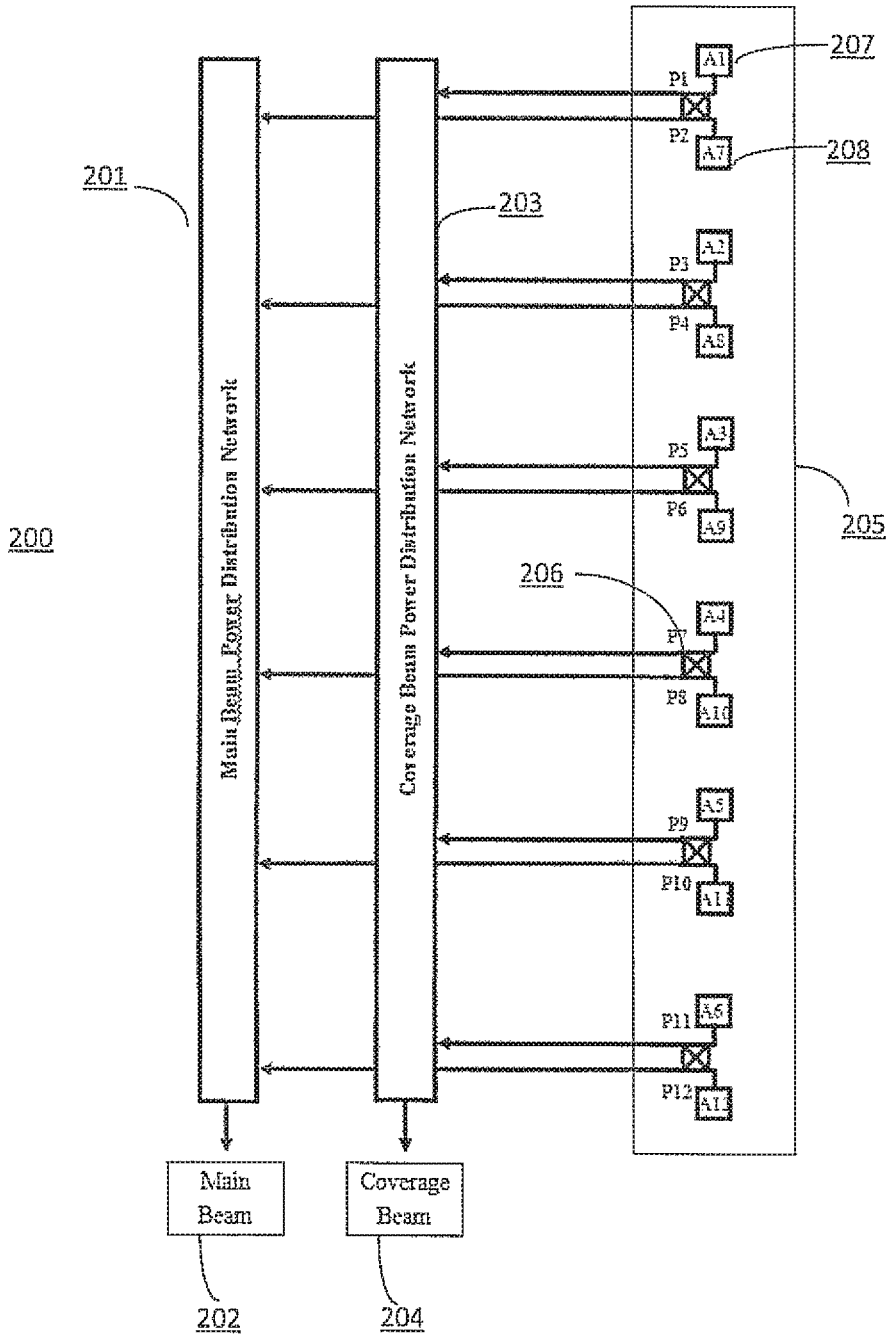
FIG. 2 is a block diagram of an exemplary feed structure and beam forming scheme of a dual vertical beam array.

With regard now to FIG. 2, the feed structure and dual beam forming scheme of antenna array 200 is depicted, according to some embodiments. The radiators (i.e., radiators 207 and 208) are fed in pair using 90 degree hybrid couplers (i.e., hybrid coupler 206). No variable phase shifter is required for the feed system. The arrangement of this feed structure ensures that the two beam ports are orthogonal at all settings of input excitations.

The outputs of the hybrid couplers are coherently summed by using two separate power distribution networks: main beam power distribution network 201 outputs main beam 202 and coverage beam power distribution network 203 outputs coverage beam 204. Main beam 202 and coverage beam 204 are independently operable from one another.

Figure 3A:
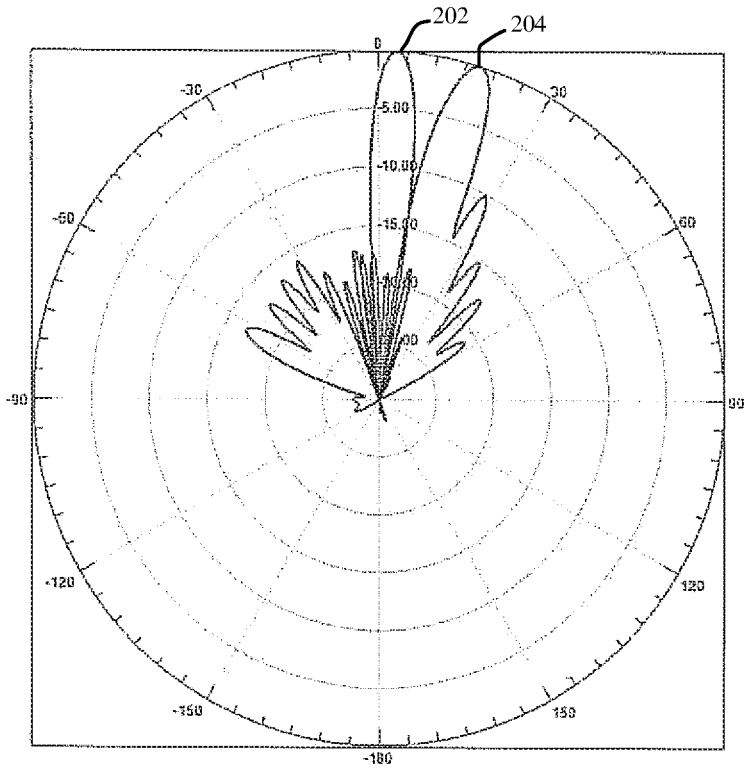
FIG. 3A is a polar plot illustrating an exemplary dual vertical beam radiation pattern.
Figure 3B:
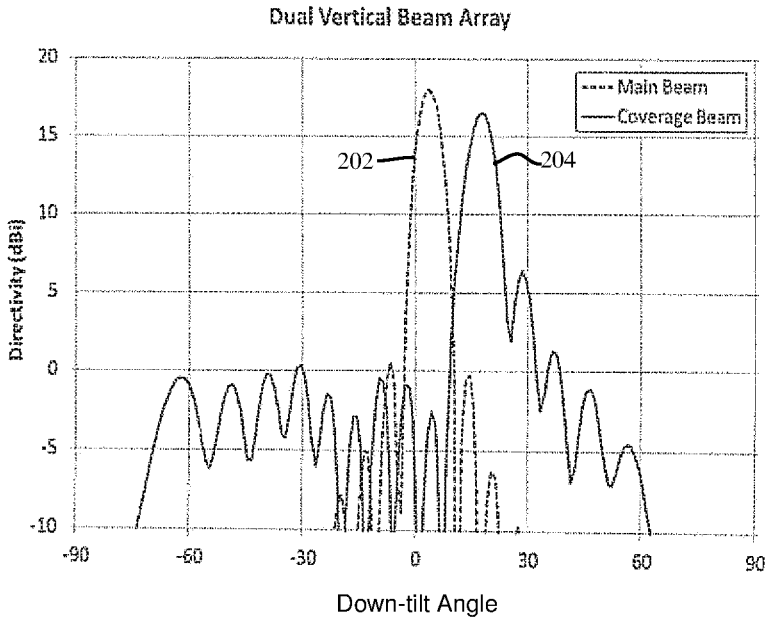
FIG. 3B is a rectangular plot illustrating exemplary absolute gain patterns of the dual vertical beams.

FIGS. 3A and 3B show typical radiation patterns of main beam 202 and coverage beam 204. With regard now to FIG. 3A, the normalized dual vertical beam radiation patterns are depicted as polar plots. The main beam 202 has a pencil-shaped radiation pattern with the beam-width directly proportional to the overall length of the array in the vertical plane. The coverage beam 204 has wide and/or fan-shaped radiation pattern which provides larger angular coverage in the near-range (high down-tilt angles) of the vertical plane.

With regard now to FIG. 3B, the absolute gain patterns of the dual vertical beam are depicted as rectangular plots. The cross-over point where these two beams intersect is critical on the overall beam coupling factor is typically set to between −9 dB to −12 dB. Furthermore, the vertical sidelobes of these beams at where the two beams overlap are typically below −18 dB for low interference.

What is claimed is:

1. A cellular antenna array, comprising:

a plurality of discrete radiators aligned in a single column;

a plurality of hybrid couplers, each of the hybrid couplers coupled to two non-adjacent discrete radiators of the plurality of discrete radiators;

a first power distribution network coupled to a first output of each of the hybrid couplers, the first power distribution network having a first beam output; and a second power distribution network coupled to a second output of each of the hybrid couplers, the second power distribution network having a second beam output that provides a single fan-shaped beam, the single fan-shaped beam including multiple discrete sidelobes.

2. The cellular antenna array of claim 1, wherein the first beam output is orthogonal to the second beam output.

3. The cellular antenna array of claim 1, wherein each of the hybrid couplers provides a 90° phase shift between the first output and the second output.

4. The cellular antenna array of claim 1, wherein a first gain of the first beam output is greater than a second gain of the second beam output.

5. The cellular antenna array of claim 1, wherein the first beam output is narrower than the second beam output.

6. The cellular antenna array of claim 1, wherein the first beam output and the second beam output have a cross-over point between −7 dB and −12 dB.

7. The cellular antenna array of claim 1, wherein a first beam provided by the first beam output and the single fan-shaped beam provided by the second beam output overlap such that vertical sidelobes at which the first and single fan-shaped beams overlap are below −18 dB.

8. The cellular antenna array of claim 1, wherein the first beam output and the second beam output point in a same vertical plane, and wherein the second beam output has a larger down-tilt angle than the first beam output.

9. The cellular antenna array of claim 1, wherein the discrete radiators are one of broadband patch antennas or broadband dipole antennas.

10. A cellular antenna array, comprising:

a plurality of discrete radiators aligned in a single column;

a plurality of 90° hybrid couplers, each of the 90° hybrid couplers coupled to two discrete radiators of the plurality of discrete radiators;

a first power distribution network coupled to a first output of each of the 90° hybrid couplers, the first power distribution network having a first beam output; and a second power distribution network coupled to a second output of each of the 90° hybrid couplers, the second power distribution network having a second beam output that provides a single fan-shaped beam, the single fan-shaped beam including multiple discrete sidelobes.

11. The cellular antenna array of claim 10, wherein the first beam output is orthogonal to the second beam output.

12. The cellular antenna array of claim 10, wherein the plurality of discrete radiators are non-adjacent.

13. The cellular antenna array of claim 10, wherein a first gain of the first beam output is greater than a second gain of the second beam output.

14. The cellular antenna array of claim 10, wherein the first beam output is narrower than the second beam output.

15. The cellular antenna array of claim 10, wherein the first beam output and the second beam output have a cross-over point between −7 dB and −12 dB.

16. The cellular antenna array of claim 10, wherein a first beam provided by the first beam output and the single fan-shaped beam provided by the second beam output overlap such that vertical sidelobes at which the first and single fan-shaped beams overlap are below −18 dB.

17. The cellular antenna array of claim 10, wherein the first beam output and the second beam output point in a same vertical plane, wherein the first beam output is pointed near the Earth's horizon, and wherein the second beam output is pointed downward for near-range coverage.

18. The cellular antenna array of claim 10, wherein the plurality of discrete radiators are one of broadband patch antennas or broadband dipole antennas.

19. The cellular antenna array of claim 1, wherein the first beam output provides a pencil-shaped beam.

20. The cellular antenna array of claim 10, wherein the first beam output provides a pencil-shaped beam.

* * * * *